US008038109B2

(12) United States Patent
Ashford

(10) Patent No.: US 8,038,109 B2
(45) Date of Patent: Oct. 18, 2011

(54) AMPLIFIER MOUNTED GUITAR STAND

(76) Inventor: Dale Frederick Ashford, Rockford, IL (US)

( * ) Notice: Subject to any disclaimer, the term of this patent is extended or adjusted under 35 U.S.C. 154(b) by 82 days.

(21) Appl. No.: 12/462,655

(22) Filed: Aug. 7, 2009

(65) Prior Publication Data

US 2011/0017886 A1 Jan. 27, 2011

Related U.S. Application Data

(60) Provisional application No. 61/188,263, filed on Aug. 8, 2008.

(51) Int. Cl.
*A47G 23/02* (2006.01)

(52) U.S. Cl. ..... 248/150; 248/205.1; 248/160; 248/460; 84/327; 84/329

(58) Field of Classification Search ..... 84/327, 84/329; 248/205.1, 309.1, 310, 443, 447.1, 248/150, 166, 460
See application file for complete search history.

(56) References Cited

U.S. PATENT DOCUMENTS

| | | | | |
|---|---|---|---|---|
| 3,765,633 | A | 10/1973 | Caudill | |
| 3,958,786 | A | 5/1976 | Mann | |
| 4,084,778 | A * | 4/1978 | Dominguez | 248/314 |
| 4,345,732 | A * | 8/1982 | Gallegos | 248/201 |
| D270,120 | S | 8/1983 | McPherson, Sr. | |
| 4,546,688 | A | 10/1985 | Cuccio | |
| 4,991,809 | A | 2/1991 | Harkey | |
| 5,313,866 | A * | 5/1994 | Smith | 84/327 |
| 5,346,073 | A | 9/1994 | Broersma et al. | |
| 5,350,143 | A | 9/1994 | Hoshino | |
| 5,664,756 | A * | 9/1997 | Liao | 248/443 |
| 5,959,225 | A * | 9/1999 | Hsu | 84/327 |
| 6,127,612 | A * | 10/2000 | Yu | 84/327 |
| 6,209,829 | B1 * | 4/2001 | Yu | 248/122.1 |
| 6,982,373 | B1 * | 1/2006 | Yu | 84/327 |
| 7,717,377 | B1 * | 5/2010 | Corrado | 248/150 |
| 7,906,717 | B2 * | 3/2011 | Wang | 84/327 |
| 2004/0056166 | A1 * | 3/2004 | Harrison | 248/434 |
| 2005/0011337 | A1 * | 1/2005 | Hsieh | 84/327 |
| 2008/0028913 | A1 | 2/2008 | Driscoll | |
| 2008/0141844 | A1 * | 6/2008 | Hsieh | 84/329 |

FOREIGN PATENT DOCUMENTS

FR 609 843 8/1926

OTHER PUBLICATIONS

Wallacher Amplifier Mount guitar stand, http//www.music123.com/Wallacher-Amplifier-Mount-Guitar Stand-451514-i1142188.Music123, 2 pages printed from the Internet, date last visited May 16, 2008.

* cited by examiner

*Primary Examiner* — Ramon Ramirez
(74) *Attorney, Agent, or Firm* — Reinhart Boerner Van Deuren, P.C.

(57) ABSTRACT

One embodiment of a support for a musical instrument, specifically a guitar. The Amplifier Mounted Guitar Stand is a device designed to hold a guitar while it is not being played and to attach to a wooden-side of an amplifier so that it is kept secure when not in use. The guitar and amplification device can be simultaneously moved around the stage as one unit. The device is made of molded plastic with foam covering on the arm and neck of the device to cushion the guitar. When not in use, pivoting supports, which enable the guitar to be stood upright against the attached plastic frame, are structured to be folded flat against the frame.

16 Claims, 9 Drawing Sheets

AMPLIFIER MOUNTED GUITAR STAND

CROSS REFERENCE TO RELATED APPLICATIONS

This application claims the benefit of provisional patent application Ser. No. 61/188,263 filed 2008 Aug. 8 by the present inventor.

FEDERALLY SPONSORED RESEARCH

Not applicable

SEQUENCE LISTING OR PROGRAM

Not applicable

BACKGROUND

1. Field of Invention

This invention relates to support for a musical instrument, specifically an electric guitar, when the guitar is not in use during live performances. The stand is designed to attach to an amplification device.

2. Prior Art

Patent documents considered relevant to the present invention (search conducted by Litman Law).

| Patent Document No. | Inventor |
|---|---|
| Des. 270,120 | McPherson, Sr. |
| US 2008/0028913 Al | Driscoll |
| 3,765,633 | Caudill |
| 3,958,786 | Mann |
| 4,345,732 | Gallegos |
| 4,546,688 | Cuccio |
| 4,991,809 | Harkey |
| 5,313,866 | Smith |
| 5,346,073 | Broersma et al. |
| 5,350,143 | Hoshino |
| Foreign Patent Document No. | Country & Date |
| 609843 (attached) | France, August 1926 |

Internet Documents

Wallacher Amplifier Mount guitar stand, http//www.music123.com/Wallacher-Amplifier-Mount-Guitar Stand-451514-i1142188.Music123, 2 pages printed from the Internet (attached)

Many musicians who play guitars and perform live require a way of supporting their guitars when they are not playing it. They often place their guitars against their amplification device where it often falls or is knocked—possibly harming the instrument. Some musicians carry a stand for their guitar to be used during live performances when they are not playing the guitar. However, the standard guitar stand is unstable, awkward to set up and transport. Often, there is not enough room on the stage to set up guitar stands.

U.S. Pat. No. 3,765,633 to Caudill (1973) allows the guitar and amplification to be rolled simultaneously. However, when the guitar is attached to the amplifier, the bottom of the guitar is on the floor or ground and the finish on the guitar could possibly be harmed. Additionally, the guitar cannot be locked up to prevent someone from taking it off the stand and playing with it.

U.S. Pat. No. 4,345,732 to Gallegos (1982) while allowing for the slight uplifting of the guitar off the floor, has no way to lift differently shaped guitars and no way to lock the instrument to the amplification device.

U.S. Patent DES 270,120 to McPherson, Sr. (1983) attached the guitar to the stand in a way that it could only be used to hold the guitar while not being played. It could not be used to carry the guitar and amplification device simultaneously.

U.S. Patent 2008/0028913A-1 to Driscoll (2008) provides support for the guitar on the amplification device but it is not a permanent support as it is either slid under the supporting handle of the amplification device or slid between two stacked amplification devises by a finger hole at one end. The musician must carry the part as a separate piece of equipment and it could be easily lost. Further, if the stand is slid between two amplification devises, all three pieces could be knocked over and the guitar harmed. Additionally, this device leaves the guitar unlocked and sitting on the floor.

General types of stands have been proposed—for example U.S. Pat. No. 4,546,688 to Cuccio (1985), U.S. Pat. No. 4,991,809 to Harkey (1991), and U.S. Pat. No. 5,313,866 to Smith (1994). All of these devices are detachable devices that are not secure and suffer from a number of disadvantages:

a) They provide no way for the musician to lock their valuable equipment on to the amplification unit.

b) They are detachable devices and not as sturdy as the current invention.

c) The instruments have to sit on the floor or ground when placed in the device.

SUMMARY

In accordance with one embodiment the Amplifier Mounted Guitar Stand comprises a foam-cushioned molded plastic permanent guitar stand that when affixed to the wood side of an amplification device allows the musician to place and lock the guitar in the guitar stand and also allows the musician to move the amplification device and guitar simultaneously on stage.

This invention is designed to address two uses for the guitar player—1) a way of keeping the guitar locked in place and secure while not being played in a way that is space saving; and 2) a way to roll the guitar and amplification device as one piece (if the musicians desires to do so).

BRIEF DESCRIPTION OF THE DRAWINGS

One embodiment of the invention will now be described in conjunction with the accompanying drawings in which.

DETAILED DESCRIPTION

Figure 2:
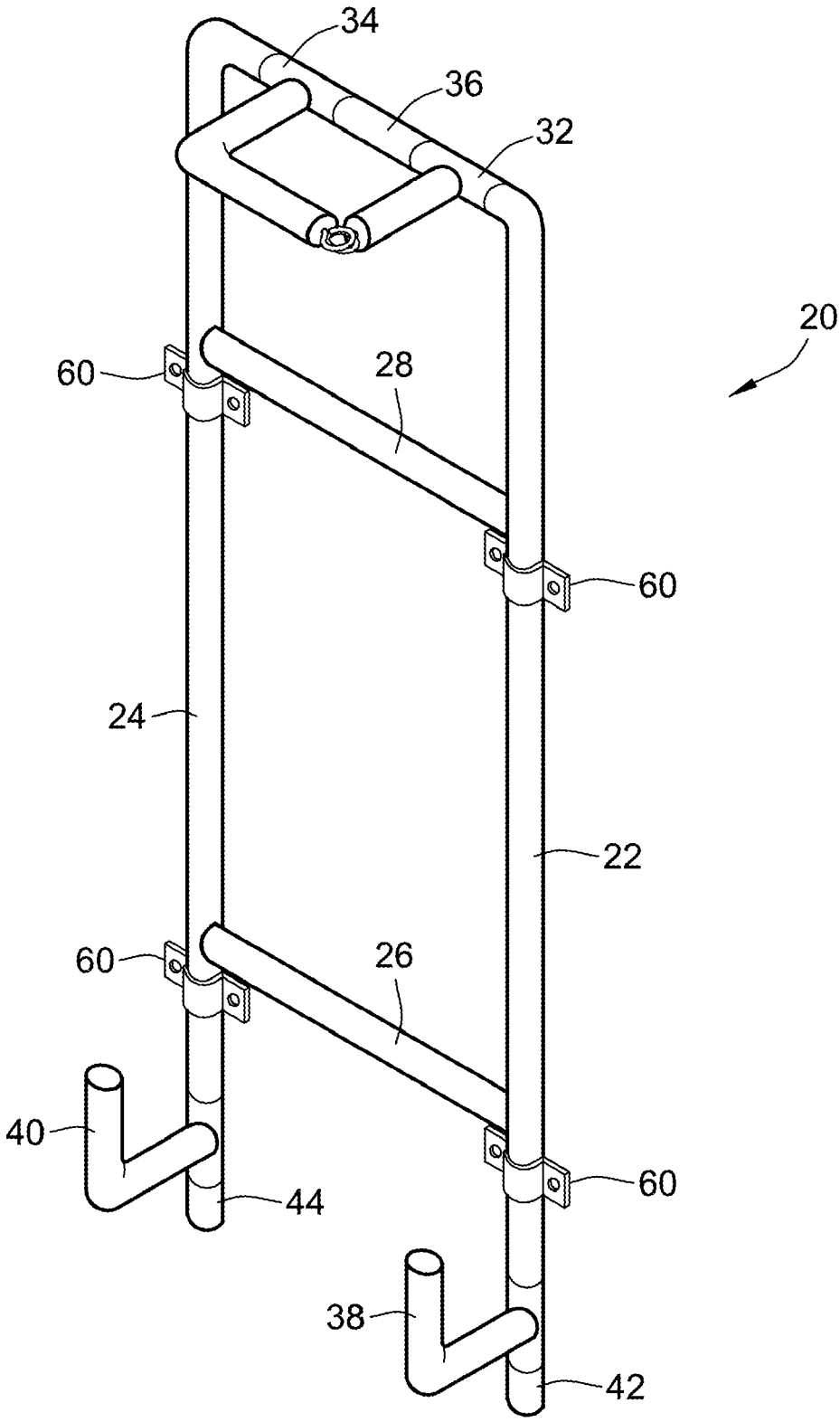
FIG. 2 is an angular view of the stand. This view shows the stand in the open position where the base of the guitar fits into the two lower swinging supports. On the top of the stand is where the neck of the guitar fits and is held into place by a swinging vertical arm that is able to be locked with a lock being run through eyelet screws.

The embodiment of the stand 20 is illustrated in FIG. 2. The stand is approximately 18 inches long and 7⅜ inches wide. It is made of molded plastic, which is approximately ⅝ inches round. The body has eight moving parts. The stand 20 has four moving parts that swivel provided by support arms for the lower part of the guitar in the form of guitar body support arms 38, 40 and the support arms for the neck in the form of guitar neck support arms 32, 34. The guitar body support arms 38, 40; (see also FIG. 7) are 3.5 inches in length and the guitar neck support arms 32, 34 (see also FIG. 8) are 3.875 inches in length and fold down for storage.

Figure 1:
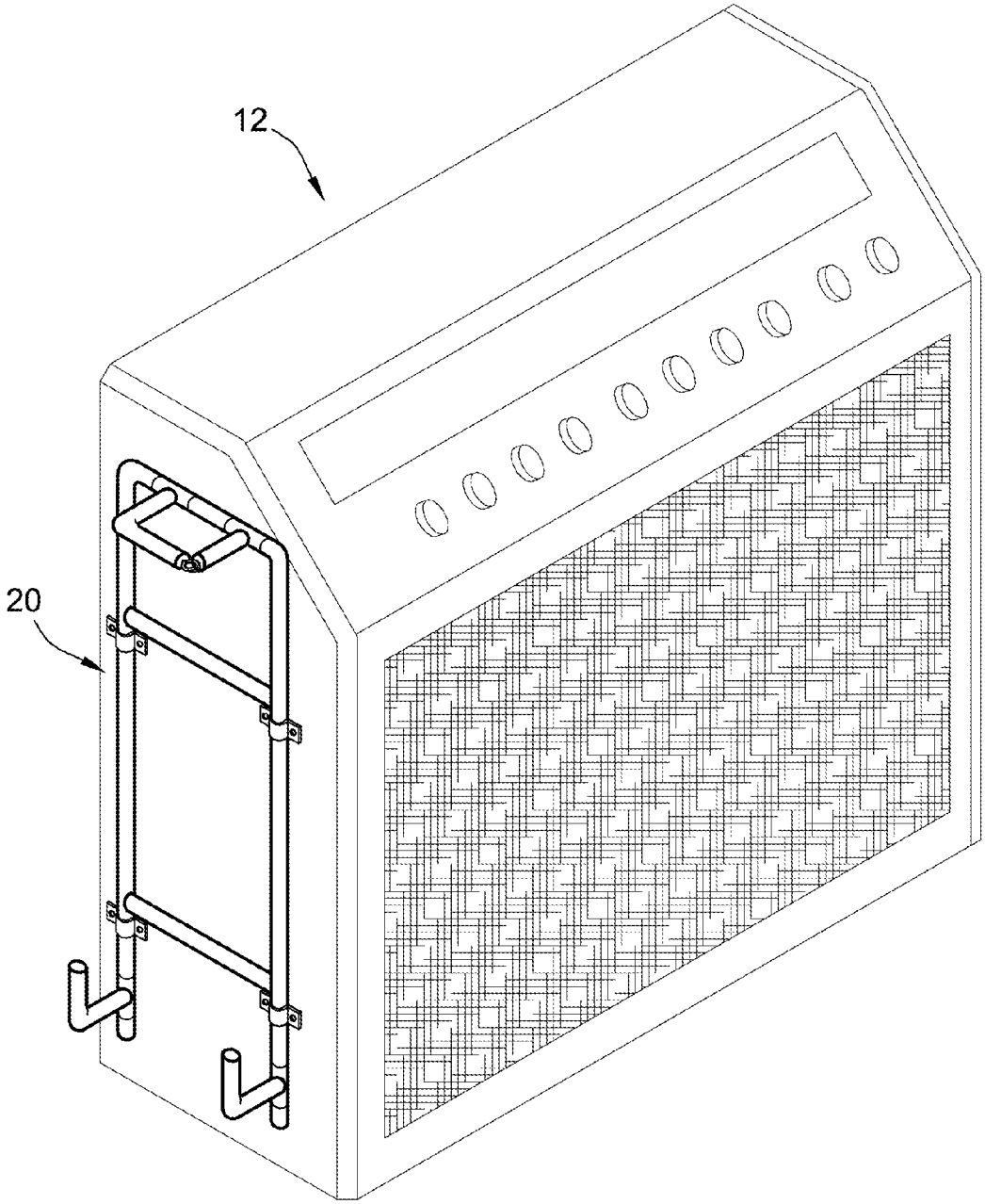
FIG. 1 is a perspective view of an embodiment of a guitar stand on the side of an amplifier with the stand attached to the side of the amplifier. The stand is a guitar instrument support constructed in accordance with the invention. The stand unit will attach to either wood side of the amplifier. The stand is mounted with wood screws to hold the stand in place. This depiction shows the unit when it is open and ready to hold a guitar. The stand is composed of hard tubular plastic.

With respect to FIG. 1 of the drawings, the stand 20 is shown attached to the amplifier unit 12 on the wooden side thereof. There are eight holes drilled into the amplifier to attach the stand 20. The holes are drilled with a 7⁄64" drill bit into the wood side of the amplifier unit 12 and then 8×1 inch wood screws are used to attach the stand 20 (FIG. 2) to the amplifier unit 12.

With respect to FIG. 2 of the drawings, the stand 20 is illustrated assembled together and unattached to the amplification unit. The four clamps 60 for the wood screws are clearly discernable in FIG. 2.

Figure 5:
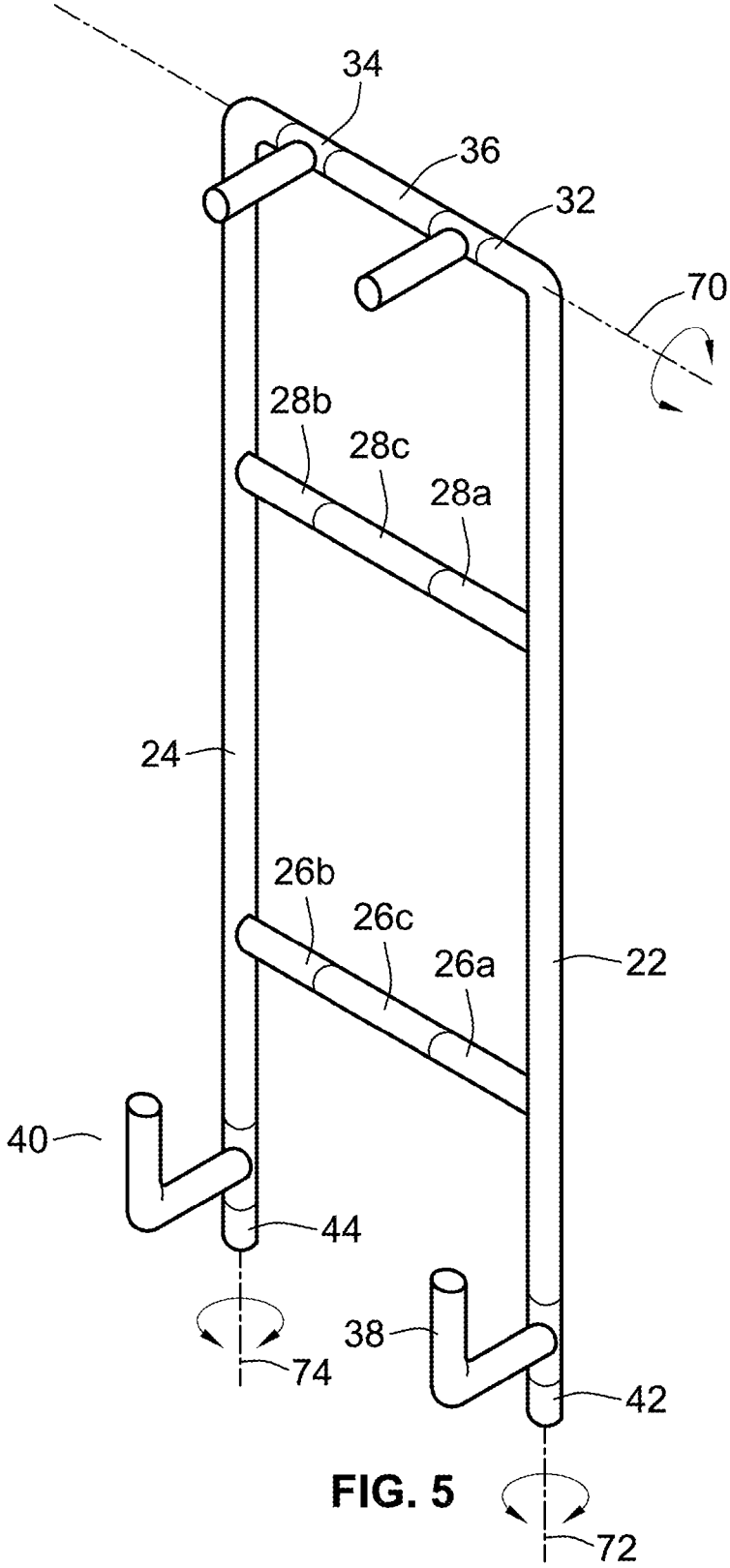
FIG. 5 is an angular assembled view of the stand with the component pieces and their relative assembly and interrelation illustrated.
Figure 6:
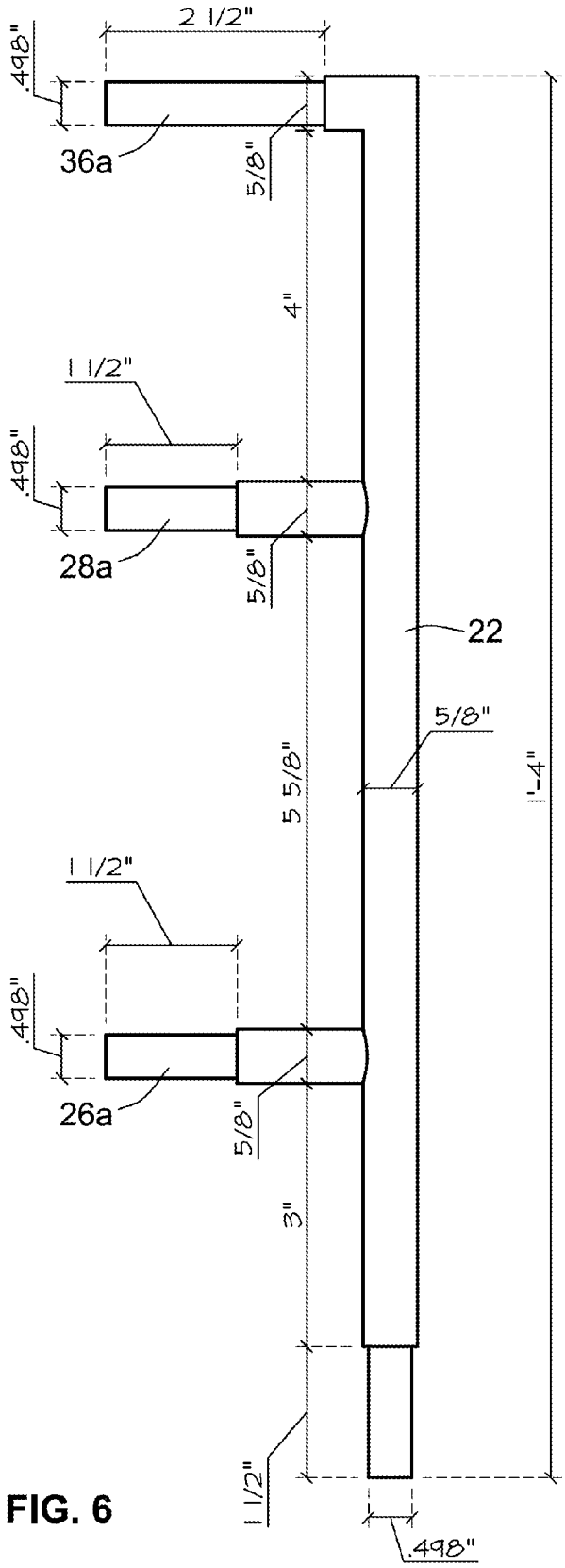
FIG. 6 is a side view of a side member of the stand showing the exemplary dimensions of this particular embodiment.

The stand 20 includes a pair of generally vertical side members 22, 24 that are identical. Three support braces 26, 28 36 extend between the vertical side members 22, 24 such that the stand 20 is essentially a rigid frame. The support braces 26, 28, 36 are shown in FIGS. 1-4 as a single continuous, and are shown at FIGS. 5 and 6. as multi-piece structures. As will be understood from inspection of these various figures, the support braces 26, 28, 36 are formed by a portion of each side member 22, 24 as well as a collar 26*c*, 28*c*, 36*c* as explained below (see FIG. 5).

Figure 3:
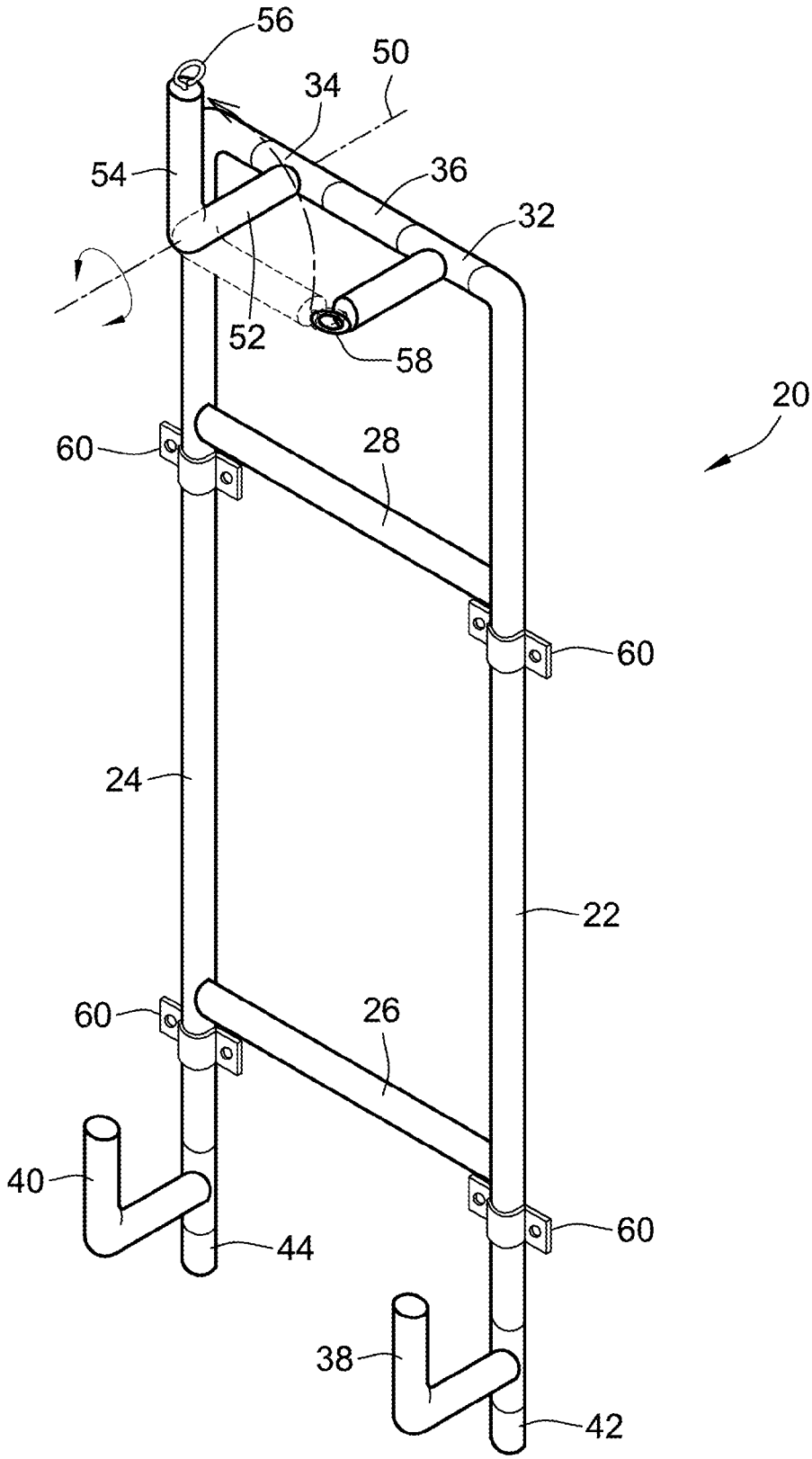
FIG. 3 is an angular view of the stand. This view depicts the eyelet screws and their attachment to the guitar neck support arms that are connected to the upper neck support brace to allow for the placement of a security lock to keep the guitar in place and discourage tampering with the guitar. The dotted line shows the alternate positions of one of the guitar neck support arms that either holds the guitar neck up or that pivots out of the way release the guitar.

With respect to FIG. 3 of the drawings, the guitar neck support arms 32, 34 that hold the neck of the guitar are illustrated (see also dotted lines of FIG. 1). The guitar neck support arms 32, 34 are molded to the body (FIG. 2) on a piece that swivels to allow the guitar neck support arms 32, 34 to fold down to lock the guitar in place. The guitar neck support arms 32, 34 fold up to allow the guitar to be removed.

The left-most guitar neck support arm 34 is generally L-shaped with a first member 52 extending away from a collar of the guitar neck support arm 34; and which is mounted to the left-most side member 24 to achieve the aforementioned swivel functionality. A second member 54 of the L-shaped guitar neck support arm 32 extends generally at a right angle to and away from the first member 52. The second member 54 is rotatably mounted with the remainder of the guitar neck support arm 32 to rotate about a first axis 50 extending through the center of the first member 52.

The dashed lines of FIG. 3 illustrate the position of the left-most guitar neck support arm when it has been rotated about the first axis 50 to lock a guitar in place via the close reception of a neck of the guitar. An eyelet screw 56 is formed at an end of the second member 54. The right-most guitar neck support arm 32 also includes an eyelet screw 58 formed at an end thereof. As illustrated, the eyelet screws 56, 58 are alignable to receive a lock to prevent rotation of the left-most guitar neck support arm 32 relative to the right-most guitar neck support arm 34 and vice versa.

Figure 4:
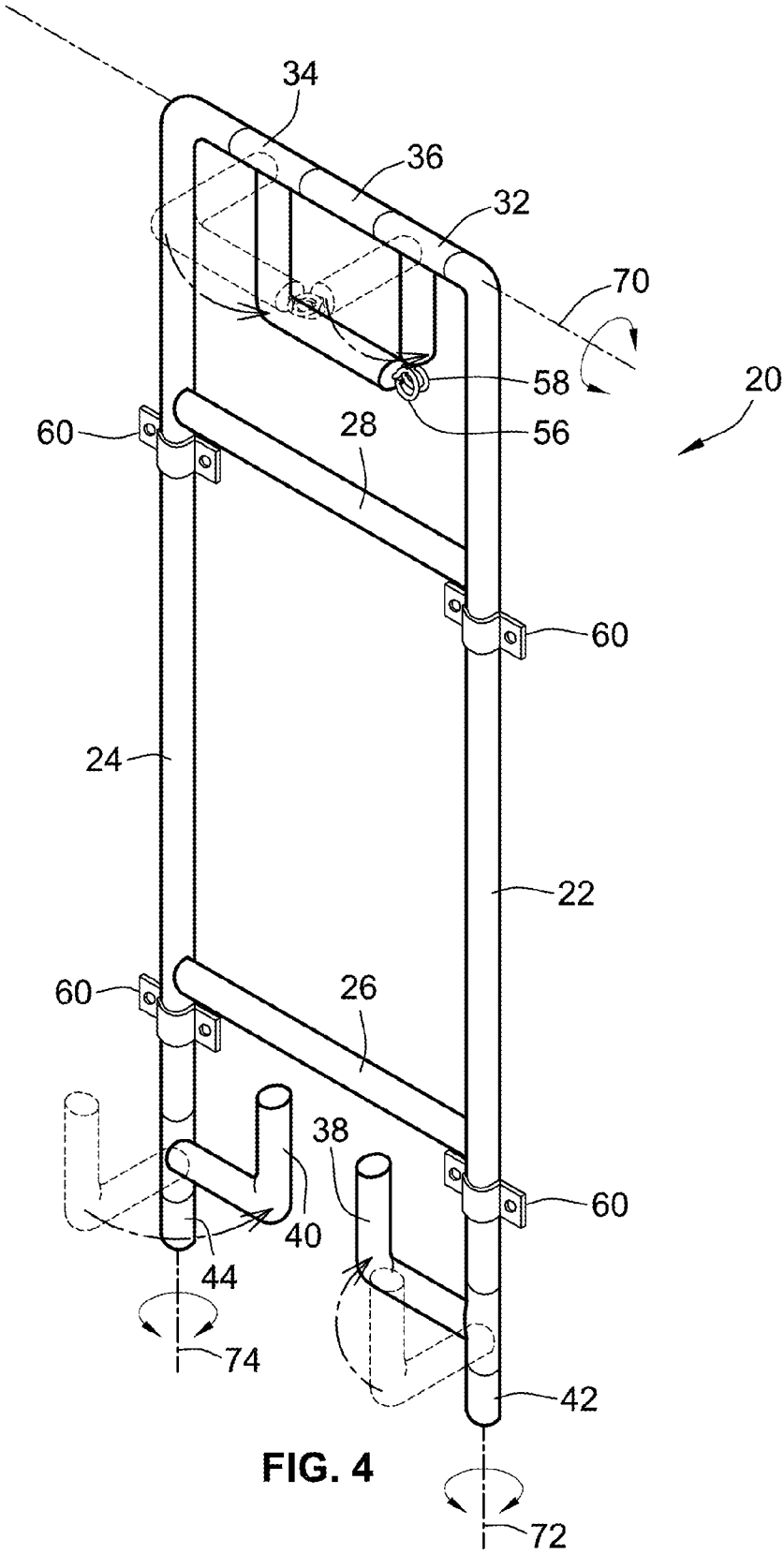
FIG. 4 is an angular view of the stand. This view shows how the guitar neck support arms at the top of the stand and a pair of guitar base support arms at the base of the stand will fold flat against the amplifier unit to will allow for a cover to be placed over the amplifier for transportation and compactness of the amplifier with the stand attached.
Figure 7:
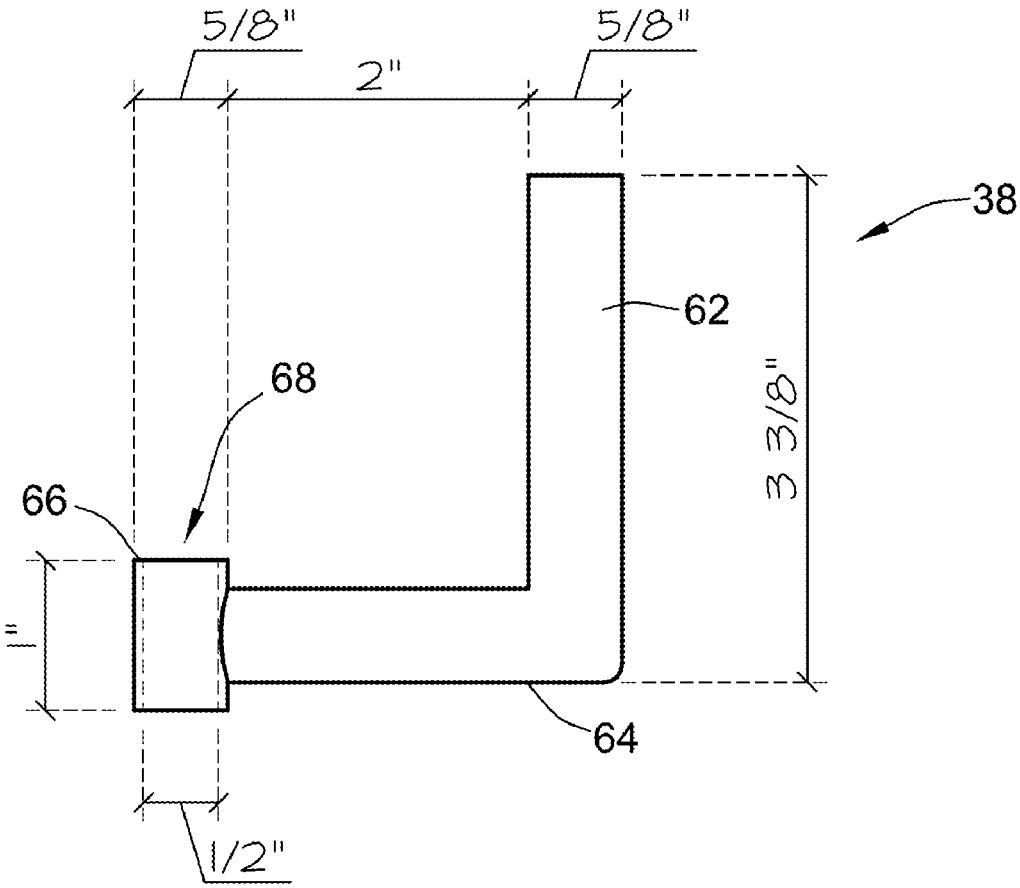
FIG. 7 shows the guitar body support arms. (See FIG. 5 for how it is attached)
Figure 8:
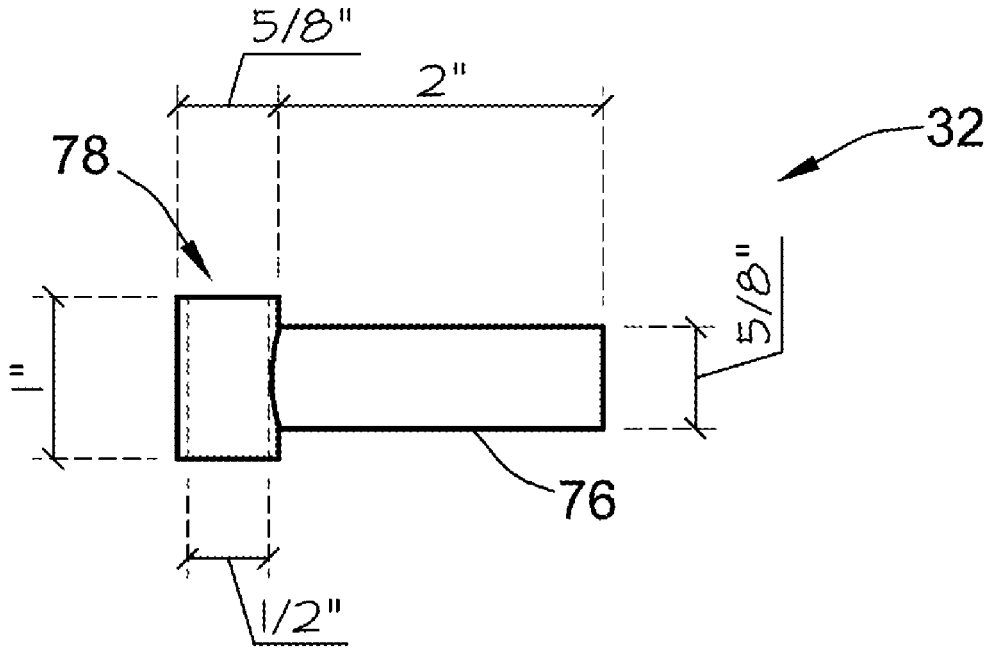
FIG. 8 shows the guitar neck support arms. (See FIG. 5 for how it is attached)

With respect to FIG. 4, this illustration shows the folding of the stand 20 for transport when on the amp (FIGS. 7 and 8). Each of the guitar neck support arms 32, 34, by way of their swivel mounted collars, mount on the upper brace 36 and are rotatable about the second axis 70 that is generally perpendicular to the first axis 50 (see FIG. 3). As illustrated, the guitar neck support arms 32, 34 rotate downward such that they are positioned within the plane of the side members 22, 24.

Similarly, the guitar body support arms 38, 40 rotate inwardly about their respective side members 22, 24 such that they are positioned within the plane of the side members 22, 24. More specifically, the right-most guitar body support arm 38 rotates about a third axis 72 that is perpendicular to each of the first and second axes 50, 70 (see also FIG. 3). In a like manner, the left most guitar body support arm 40 rotates about a fourth axis 74 that is perpendicular to each of the first and second axes 50, 70 (see also FIG. 3). As a result, the stand 20 has generally non-planar presentation in a guitar carrying position, and a planar presentation in a stored position. At a terminal end of each of the side members 22, 24, an end cap 42, 44 is fastened thereto to retain the guitar body support arms 38, 40 in either positions along the side members 22, 24.

Figure 9:
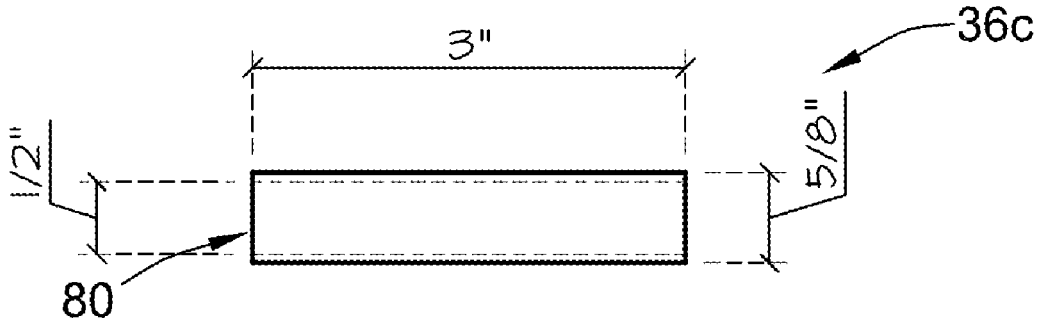
FIG. 9 shows a spacer of the stand used to connect the side members and space apart the guitar neck support arms and the guitar body support arms. (See FIG. 5 for how it is attached)

With respect to FIG. 5, this shows the component pieces of each support brace 26, 28, 36 and how they are used (FIG. 9). The lower-support brace 26 (see also FIG. 2) is formed by a portion of each support member 22, 24. More specifically, portion 26*a* is formed by the left-most support member 22. Portion 26*b* is formed by the right-most support member 24. These portions are connected by a spacer 26*c* that slidably receives portions 26*a* and 26*b* within an internal bore 180 (see FIG. 9). From inspection of FIG. 5, it will be recognized that the same configuration described above is present with respect to support brace 28 formed by portions 28*a*-28*c*, as well as support brace 36 formed by portions 36*a*-36*c*. The guitar neck support arms 32, 34 are shown in a schematic illustration for clarity in this view.

With respect to FIG. 6, this shows one of the side members 22, 24 and the dimensions thereof. The other side member 24, is identical to the illustrated side member 22.

With respect to FIG. 7, this shows one of the two guitar body support arms 38, 40 for supporting the body of the guitar. These arms hold the guitar to keep it from sitting on the floor. Each of the guitar body support arms 38, 40 includes a first member 62 and a second member 64 generally perpendicular to the first member 62. A collar 66 is formed at an end of the second member 64 which includes a bore 168 for receipt of the side members 22, 24 to permit the swivel functionality described above.

With respect to FIG. 8, this shows a portion of one of the guitar neck support arms 32, 34 for the neck of the guitar to hold the guitar in place to keep it from falling. Each guitar neck support arms 32, 34 includes a collar with a bore 178 formed therein for receipt of the side members 22, 24 to permit the swivel functionality described above.

With respect to FIG. 9, this shows the spacer 36*c* that receives the portions of the side members 22, 24 described above. Although only spacer 36*c*, is illustrated, it will be recognized that spacers 26*c*, 28*c* are identical to the illustrated spacer 36*c*.

Operation:

Utilization of the stand 20 allows the musician to use the guitar during playing engagement or at home without having to unpack their instrument. The unit is mounted on a base which will provide a secure and stable environment for the guitar, which will reduce guitars being knocked down from being leaned against walls or amplifiers. The stand 20 makes the guitar more accessible to the musician as they will not have to re-case the guitar between music sets or when at home. A major improvement of this invention is that it keeps the guitar off of the floor. Constantly leaving guitars on the various floor surfaces has the potential to damage the ascetics of the guitar and reduce it value. Additionally, most other units of this type are stand along by attaching the stand to the amplifier it reduces a common complaint that musicians have of leaving their stands at various musical engagements.

I claim:

1. A foldable guitar stand for attachment to an amplification unit, the guitar stand comprising:

a pair of generally vertical side members;

a plurality of generally horizontal support braces extending between the side members such that the pair of side members are in an opposed spaced relationship;

a pair of guitar neck support arms rotatably mounted to one of the plurality of support braces;

a pair of guitar body support arms, wherein one guitar body support arm is rotatably mounted to one of the pair of side members, and wherein the other guitar body support arm is rotatably mounted to the other one of the pair of side members; and wherein the pair of guitar body support arms and the pair of guitar neck support arms are foldable between a guitar carrying state and a folded state, with the pair of guitar body support arms and the pair of guitar neck support arms generally coplanar with the pair of side members and the plurality of support braces in the folded state.

2. The guitar stand of claim 1, wherein the pair of guitar body supports and the pair of guitar neck supports extend transversely away from a remainder of the stand in the guitar carrying state.

3. The guitar stand of claim 2, wherein each of the guitar neck support arms includes an eyelet screw formed at an end thereof for receiving a lock.

4. The guitar stand of claim 3, wherein the pair of side members and the plurality of support braces include integral foam cushioning.

5. The guitar stand of claim 3, wherein the guitar neck support arms are pivotable to align the eyelet screws thereof to define a barrier for the close reception of a neck of a guitar.

6. The guitar stand of claim 1, wherein the pair of guitar body support arms are mounted to the pair of side members below the pair of guitar neck support arms.

7. The guitar stand of claim 6, wherein the guitar body support arms are generally L-shaped and each include a first and a second member arranged perpendicular to one another, with the second members arranged to receive a bottom portion of a guitar and elevate the guitar above ground.

8. A foldable guitar stand for attachment to an amplification unit, the guitar stand comprising:

a pair of generally vertical side members;

a plurality of generally horizontal support braces extending between the side members such that the pair of side members are in an opposed spaced relationship;

a pair of guitar neck support arms rotatably mounted to one of the plurality of support brace, wherein one of the guitar neck support arms is rotatable about a first axis and a second axis generally perpendicular to the first axis, and wherein the other one of the guitar neck support arms is rotatable about the second axis;

a pair of guitar body support arms, wherein one guitar body support arm is rotatably mounted to one of the pair of side members and is rotatable about a third axis, and wherein the other guitar body support arm is rotatably mounted to the other one of the pair of side members and is rotatable about a fourth axis, wherein the third and fourth axes are generally parallel to one another and wherein the third and fourth axes are generally perpendicular to the first and the second axes.

9. The guitar stand of claim 8, wherein the plurality of support braces includes first, second, and third support braces extending between the pair of side members to form a generally ladder shaped frame.

10. The guitar stand of claim 9, wherein each of the first, second, and third support braces is a multi-piece structure formed by a portion of each side member and a spacer connecting each portion.

11. The guitar stand of claim 10, wherein the spacer is a tubular shaped element having a bore therethrough.

12. The guitar stand of claim 11, wherein the portions of the side members are received within the bore of the spacer.

13. The guitar stand of claim 8, wherein each of the pair of guitar neck supports includes a collar portion formed at an end thereof, the collar portion including a bore therethrough for receipt of a portion of one of the side members.

14. The guitar stand of claim 13, wherein each of the pair of guitar neck supports is rotatably mounted to one of the first, second, and third support braces, with the spacer mounted therebetween.

15. The guitar stand of claim 14, further comprising an end cap mounted at an end of each of the pair of side supports and below the pair of guitar body support arms.

16. The guitar stand of claim 8, further comprising an amplification unit, wherein the guitar stand is foldable between a guitar carrying state such that the amplification unit and a guitar carried by the guitar stand are movable together as a unit, and a folded state wherein the guitar stand has a generally planar presentation along the side of the amplification unit.

* * * * *